United States Patent [19]

Butlak et al.

[11] 3,980,069

[45] Sept. 14, 1976

[54] INSERT FOR A RADIANT HEATING SYSTEM

[75] Inventors: Eugene W. Butlak, Buffalo; Robert G. Budden, Clarence, both of N.Y.

[73] Assignee: Roberts-Gordon Appliance Corporation, Buffalo, N.Y.

[22] Filed: Sept. 22, 1975

[21] Appl. No.: 615,379

[52] U.S. Cl. ..... 126/91 A; 110/97 D; 431/353

[51] Int. Cl.[2] ..... F24C 3/00

[58] Field of Search ..... 126/91 A, 92 B; 431/353, 347; 110/97 D

[56] References Cited

UNITED STATES PATENTS

| | | | |
|---|---|---|---|
| 2,115,769 | 5/1938 | Harris | 126/91 A |
| 2,410,881 | 11/1946 | Hunter | 126/91 A X |
| 2,641,206 | 6/1953 | Stout | 110/97 D |
| 2,847,953 | 8/1958 | Ernst | 110/97 D |
| 3,066,727 | 12/1962 | Galvin | 126/91 A |

*Primary Examiner*—Edward G. Favors
*Attorney, Agent, or Firm*—Sommer & Sommer

[57] ABSTRACT

An insert is adapted to be arranged within the marginal end portion of a heat-radiating tube. The insert has an outer surface comprising an alternating series of peaks and valleys. The insert serves to insulate the tube marginal portion from the direct heat of a flame directed into and confined within the insert. The outer surface of the insert defines with the tube inner surface, a plurality of passageways. In use, air drawn into the tube through these passageways is preheated, and subsequently directed to oxidize the flame tip.

4 Claims, 4 Drawing Figures

INSERT FOR A RADIANT HEATING SYSTEM

BACKGROUND OF THE INVENTION

1. Field of the Invention

The present invention relates generally to improvements in a radiant-type heating system, and more particularly to a tubular insert which may be inserted into a heat-radiating tube to insulate the tube marginal portion from the immediate heat of a flame, directed into the tube from an open end thereof, to preheat air delivered to oxidize the flame tip, and to reduce the heat gradient along the operative tube length.

2. Description of the Prior Art

In radiant heating systems of the general type disclosed in U.S. Pat. No. 3,310,047, a flame is directed into an open end of an elongated tube. When so heated, the operative length of the tube emits usable infrared radiation which is appropriately directed toward the desired space or object to be heated.

However, several problems accompany the use of such heating systems. First, it is difficult to heat the tube to a uniform temperature along its entire operating length because the heat source is arranged at one end. In other words, by providing the flame at one end of the tube, an undesirable heat gradiant tends to develop along the tube. Otherwise stated, the tube is normally hotter proximate the flame than it is at a remote location. Of course, it is generally desired to heat the tube uniformly along its length.

Another problem is the difficulty in completely oxidizing the flame so as to reduce hydrocarbons in the fuel to carbon dioxide and water.

SUMMARY OF THE INVENTION

The present invention provides an improvement particularly adapted for use in such heating systems, and which is designed to overcome the aforementioned deficiencies.

The improvement may be used in a heating system having a burner head spaced from an open end of an elongated heat-radiating tube, and wherein the burner head is adapted to deliver a fuel to direct and support a flame within a marginal portion of the tube proximate or adjacent its open end.

The improvement comprises a tubular insert adapted to be positioned within the tube marginal portion, and further adapted to insulate the tube marginal portion from the direct heat of the flame and to insure efficient combustion of the fuel. The insert has a corrugated outer surface comprising an alternating series of circumferentially-spaced longitudinally-extending peaks and valleys. The peaks are adapted to contact the inner surface of the tube to maintain the axis of the insert substantially coincident with the axis of the tube.

The insert serves to insulate the tube marginal portion from the direct heat of the flame, and serves to preheat air drawn into the tube and passing through spaces between the valleys and the tube inner surface to insure efficient combustion of the fuel.

When viewed in transverse cross-section, the insert may appear as a hollow, multi-pointed star.

Preferably the insert has at least ten peaks, and has a length sufficient to substantially embrace the flame, this length being normally at least three times the nominal diameter of the tube.

Accordingly, one object of the present invention is to provide an insert for a radiant-type heating system.

Another object is to improve the heat gradiant of a radiant-type heating system.

Another object is to provide an insert for use in a radiant-type heating system, and to insure efficient combustion of a flame-supporting fuel.

Still another object is to provide an improved insert capable of preheating air drawn into a heat-radiating tube.

These and other objects and advantages will become apparent from the foregoing and ongoing specification, the drawings, and the appended claims.

DESCRIPTION OF THE PREFERRED EMBODIMENTS

Figure 1:
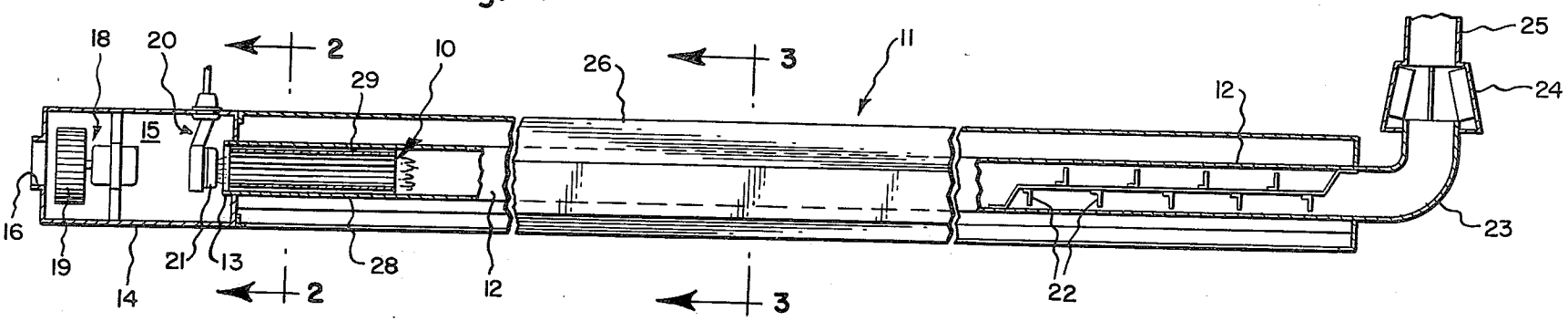
FIG. 1 is a fragmentary view, partly in central longitudinal vertical cross-section and partly in side elevation, of a radiant-type heating system, this view showing the tube, the burner assembly and the baffle assembly, and particularly showing the insert arranged in the marginal left end portion of the tube.

At the outset, it should be clearly understood that like reference numerals are intended to identify the same elements and/or structure consistently throughout the several drawing figures, as such elements and/or structure may be further described or explained by the entire written specification of which this detailed description is an integral part.

Figure 4:
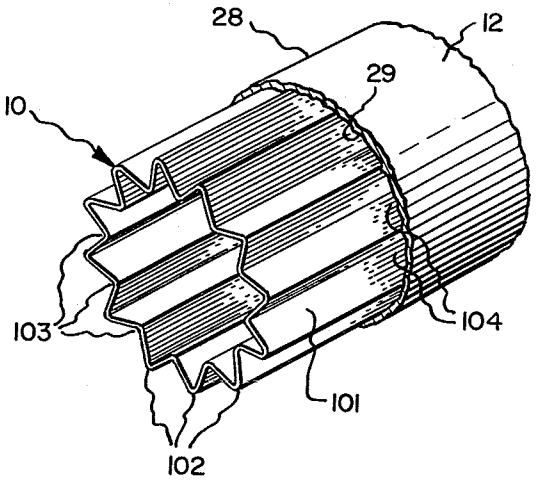
FIG. 4 is a further enlarged fragmentary perspective view of the tube marginal portion, with a portion thereof being cut away to expose the outer surface of the insert.

Referring initially to FIGS. 1 and 4, the present invention provides a tubular insert, generally indicated at 10, which is particularly adapted for use in a radiant-type heating system, generally indicated at 11, of the general type disclosed in U.S. Pat. No. 3,310,047, the disclosure of which is hereby incorporated by reference.

To further describe one possible environment of intended use, the heating system 11 is shown as including a horizontally-elongated thin-walled tube 12 having a circular cross-section (FIG. 2) with a nominal four-inch outside diameter and an open left end 13 (FIG. 1). An enclosing wall 14 proximate this tube left end 13 defines an internal compartment 15 communicating with the atmosphere through an opening 16 provided through its vertical left end, and communicating with the interior of tube 12 through open end 13.

A blower assembly, generally indicated at 18, includes an electric motor suitably arranged within compartment 15 and having its output shaft arranged to rotate a blower wheel 19 by which air may be drawn into compartment 15 through enclosing wall opening 16.

A burner assembly 20 is shown penetrating the enclosing wall 14 to have its burner head 21 operatively arranged within the compartment 15 to sustain a flame within tube 12. As shown, this burner head 21 is spaced longitudinally from the tube open end 13 to permit air to be drawn into the tube. This burner assembly 20 may be of any suitable type, and includes the necessary piping and control devices to deliver a supply of fuel and air, in the relative proportions desired, to burner head 21.

A plurality of nine longitudinally-spaced baffles 22 are positioned within the tube 12 toward its right end to provide a series flow resistance, and to induce turbulance in the flow of hot gases passing through this portion of the tube. Continuing rightwardly in FIG. 1, tube 12 is shown further provided with a ninety degree elbow 23, a draft hood 24, and an uppermost vertical conduit 25 leading to exhaust.

A horizontally-elongated hood structure 26 is shown as spaced from but surrounding the top and side portions of the tube 12 for the operative portion of its length. This hood structure 26 is open at its bottom (FIG. 3), and acts as a heat reflector to direct heat radiated from the top and side portions of the tube downwardly through the open bottom of the hood structure toward a space or object to be heated, as schematically depicted in FIG. 3.

In operation, blower wheel 19 is rotated in the appropriate angular direction to draw air into the compartment 15 through opening 16. The rightward flow of such air passes around burner assembly 20 and may enter tube 12 through its open left end 13.

A gaseous fuel and air are delivered through the burner assembly 20 and pass through burner head 21 as a combustible mixture, where it is ignited and burned within the marginal portion 28 of the tube 12 proximate its left end 13. The heat and other products of such combustion advance rightwardly along the tube 12 in a laminar flow until forced into turbulance by passage through the restricted tortuous conduit defined by the plurality of longitudinally-spaced baffles 22. After leaving the last baffle, such flow continues through elbow 23, draft hood 24, and thence to exhaust.

Figure 3:
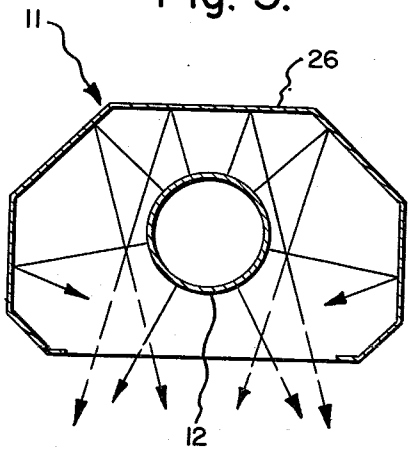
FIG. 3 is an enlarged fragmentary transverse vertical sectional view thereof, taken generally on line 3—3 of FIG. 1, this view being generally similar to FIG. 2 but schematically illustrating heat radiating from the tube being reflected by the hood structure.

During such operation, tube 12 becomes heated and emits infrared radiation which is directed downwardly by the contour of hood structure 26 to heat the intended space or object, this being schematically depicted in FIG. 3.

However, one problem attendant the use of heating system 11 has been the heat gradiant along the operative length of tube 12, this operative length extending from left end 13 to the last baffle 22. It may be readily appreciated that during the operating heretofore described, the sustained flame proximate the burner head 21 may cause the tube marginal portion 28 to reach an undesired high temperature. Moreover, in such heating systems, it is generally desirable to heat the tube 12 as uniformly as possible along its operative length, so as to radiate an even or uniform heat.

To this and other ends, the present invention provides a tubular insert, generally indicated at 10, which is adapted to be arranged within the marginal end portion 28 of the tube, and is further adapted to contain or confine the flame to insulate the tube marginal portion 28 from the direct heat of the flame and to insure efficient combustion of the fuel.

Figure 2:
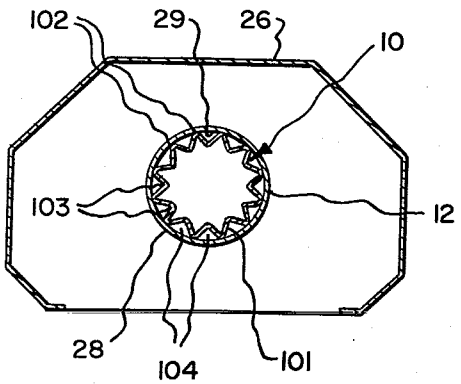
FIG. 2 is an enlarged fragmentary transverse vertical sectional view thereof, taken generally on line 2—2 of FIG. 1, showing the tube marginal portion and the insert arranged therein, and further showing the surrounding hood structure in transverse cross-section.

Referring particularly to FIG. 4, the presently preferred embodiment of insert 10 is shown as having a corrugated outer surface 101 comprising an alternating series of circumferentially-spaced longitudinally-extending peaks 102 and valleys 103, this appearing as a hollow multi-pointed star when viewed in transverse cross-section (FIG. 2). The peaks 102 are adapted to contact the inner surface 29 of the tube to maintain the longitudinal axis of the insert 10 substantially coincident with the longitudinal axis of the tube.

The configuration of the outer surface 101 of the insert defines with inner surface 29 of the tube, a plurality of circumferentially-spaced longitudinally-extending ports or passageways 104 which severally appear to have a substantially triangular cross-section when viewed in transverse cross-section (FIG. 2).

When the insert 10 has been positioned within the tube marginal portion 28, as shown in FIG. 1, the flame will be substantially confined within the hollow insert. Thus, the insert 10 is effective to insulate the tube marginal portion 28 from the direct or immediate heat of the flame. At the same time, it will be appreciated that the flame will heat the insert, such that air drawn into the tube 12 through the plurality of passageways 104 will be preheated. After passing through these passageways, this preheated air will be available to oxidize the flame tip to insure complete combustion of the fuel.

While the presently preferred embodiment of insert 10 herein illustrated and described, has ten peaks 102, it will be appreciated that other configurations might also be adopted to obtain similar results. Moreover, it is felt that by further increasing the number of such peaks, a more laminar flow of heat downstream of the insert may be obtained. While the length of the insert 10 is not deemed as being particularly critical, it is preferred that the insert be of sufficient length to confine the substantial length of the flame, such that preheated air passing through passageways 104 may be delivered to the flame tip.

Thus, it will be seen that the present invention broadly provides a tubular hollow insert arranged within the marginal end portion of a heat-radiating tube, and adapted to contain the flame to insulate the tube marginal portion from the direct heat of the flame and to insure efficient combustion of the fuel. The insert broadly includes a corrugated outer surface having an alternating series of circumferentially-spaced peaks and valleys which extend the full length of the insert. The peaks are adapted to maintain the tube and insert axes substantially coincident with one another. Functionally, the insert serves to insulate the tube marginal portion, and the relatively large area of insert outer surface 101 is available to preheat air drawn into the tube and passing through the passageways 104 between the insert outer surface 101 and the tube inner surface 29 to insure efficient combustion of the fuel.

While a preferred embodiment of the invention has been shown and described, it will be appreciated by persons skilled in this art that various changes and modifications may be readily made without departing from the spirit of the invention which is defined by the following claims.

What is claimed is:

1. In a heating system having a burner head spaced from an open end of an elongated heat-radiating tube and adapted to deliver a fuel to support a flame within a marginal portion of said tube adjacent said end, the improvement comprising:

a tubular insert arranged within such tube marginal portion and adapted to contain said flame to insulate said tube marginal portion from the heat of said flame and to insure efficient combustion of said fuel, said insert having a corrugated outer surface comprising an alternating series of longitudinally-extending peaks and valleys, said peaks adapted to contact the inner surface of said tube to maintain the axis of said insert substantially coincident with the axis of said tube, whereby said insert may insulate said tube marginal portion from the heat of said flame and may preheat air drawn into said tube and passing through the spaces between said valleys and said tube inner surface to insure efficient combustion of said fuel.

2. The improvement as set forth in claim 1 wherein said insert appears as a multi-pointed star, when viewed in transverse cross-section.

3. The improvement as set forth in claim 1 wherein said insert has at least ten of said peaks.

4. The improvement as set forth in claim 1 wherein the length of said insert is at least three times the inside diameter of said tube.

* * * * *